United States Patent [19]

Cines

[11] 4,115,524

[45] Sep. 19, 1978

[54] PRODUCTION OF CARBON MONOXIDE

[75] Inventor: Martin R. Cines, Bartlesville, Okla.

[73] Assignee: Phillips Petroleum Company, Bartlesville, Okla.

[21] Appl. No.: 764,927

[22] Filed: Feb. 2, 1977

[51] Int. Cl.[2] ..... C01B 31/18

[52] U.S. Cl. ..... 423/415 A; 423/622; 423/623; 75/86; 75/88; 48/197 R; 422/232

[58] Field of Search ..... 23/284, 260, 288 H, 23/288 K, 288 L; 423/415 A, 622, 623, 107; 75/86, 88; 48/196 R, 197 R; 165/107, DIG. 12

[56] References Cited

U.S. PATENT DOCUMENTS

| | | | |
|---|---|---|---|
| 799,743 | 9/1905 | Mackay | 75/88 |
| 1,355,904 | 10/1920 | McKee | 423/623 |
| 1,899,184 | 2/1933 | de Simo | 48/196 R |
| 2,333,845 | 11/1943 | Danforth | 165/107 X |
| 2,342,368 | 2/1944 | Queneau | 75/86 X |
| 3,968,833 | 7/1976 | Strindehag et al. | 165/107 X |

*Primary Examiner*—Earl C. Thomas

[57] ABSTRACT

A carbon monoxide- and zinc-containing gas is produced by the endothermic reaction of a carbonaceous material with zinc oxide. Zinc separated from the gas is in part reoxidized with air and in part reoxidized with $H_2O$ to form zinc oxide both in exothermic reactions. Heat developed in these exothermic reoxidations is transferred to the endothermic CO-forming reaction so that the total system is thermally neutral, in other words neither generates nor consumes heat.

14 Claims, 2 Drawing Figures

PRODUCTION OF CARBON MONOXIDE

This invention relates to the production of carbon monoxide.

More specifically this invention relates to the gasification of solid or heavy liquid carbon sources. A further aspect of this invention is the gasification of carbon sources in the absence of air.

BACKGROUND OF THE INVENTION

The conversion of solid carbon sources to a gas was developed many years ago. One process known as coal gasification contacts coal and steam under elevated temperature conditions to provide a gas consisting essentially of carbon monoxide and hydrogen, also called synthesis gas. The coal gasification processes are of great interest since they generally have the advantages of providing the potential of an environmentally clean process for coal utilization, of producing a high heating value gas via methanation of the product hydrogen and carbon monoxide which can substitute for natural gas, or of producing a lower heating value gas suitable for use as synthesis gas for subsequent conversion to hydrocarbons or chemicals or as boiler fuel.

The introduction of air into a coal gasification process is generally undesirable since larger volumes of gases have to be handled in this process. It is, therefore, desirable to have a process available which uses a different oxygen source than air for the conversion of the carbon sources into carbon monoxide. In cases where the carbon monoxide-forming reaction is an endothermic reaction, a further problem, namely the provision of the heat for the reaction, arises. It would be desirable to have means available by which the heat necessary for the carbon monoxide-forming reaction can be at least partially furnished from another process step. Furthermore, it would be desirable to have a completely heat balanced system available wherein the heat consumed and lost equals the heat generated and wherein this equilibrium can be maintained without addition or withdrawal of heat from outside of the reaction loop system.

THE INVENTION

It is, therefore, one object of this invention to provide a process for the production of carbon monoxide.

Another object of this invention is to provide a process for the production of carbon monoxide from carbon sources essentially in the absence of air in the carbon monoxide-forming reaction.

A further object of this invention is to provide a process for the production of carbon monoxide from solid carbon sources and solid oxygen donor materials in which the reduced oxygen donor can be readily reoxidized and recycled.

Yet a further object of this invention is to provide a process for the production of carbon monoxide which process also produces hydrogen.

Still another object of this invention is to provide a process for the production of carbon monoxide with an optimal utilization of the heat generated in the process.

A yet further object of this invention is to provide an apparatus for the production of carbon monoxide from carbonaceous materials.

Figure 1:
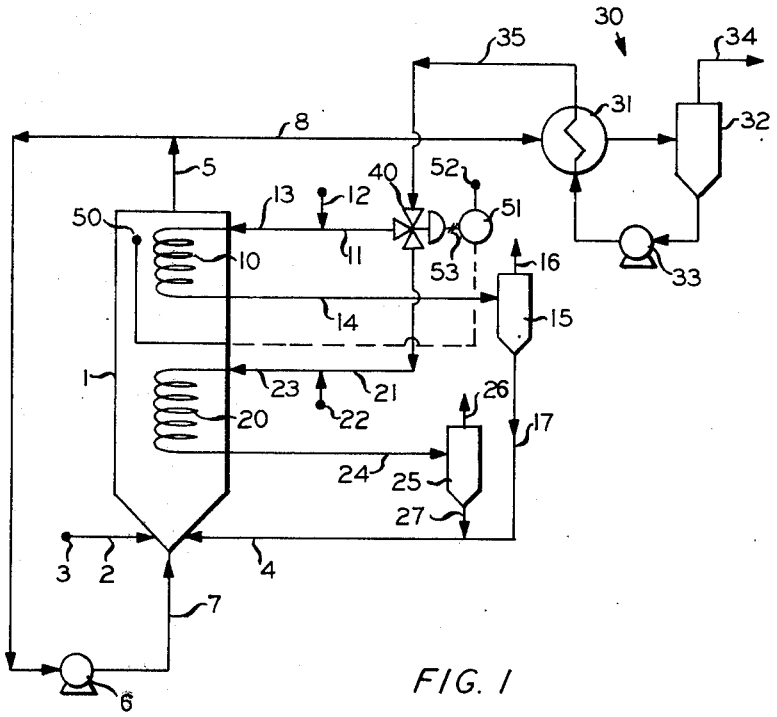
Figure 2:
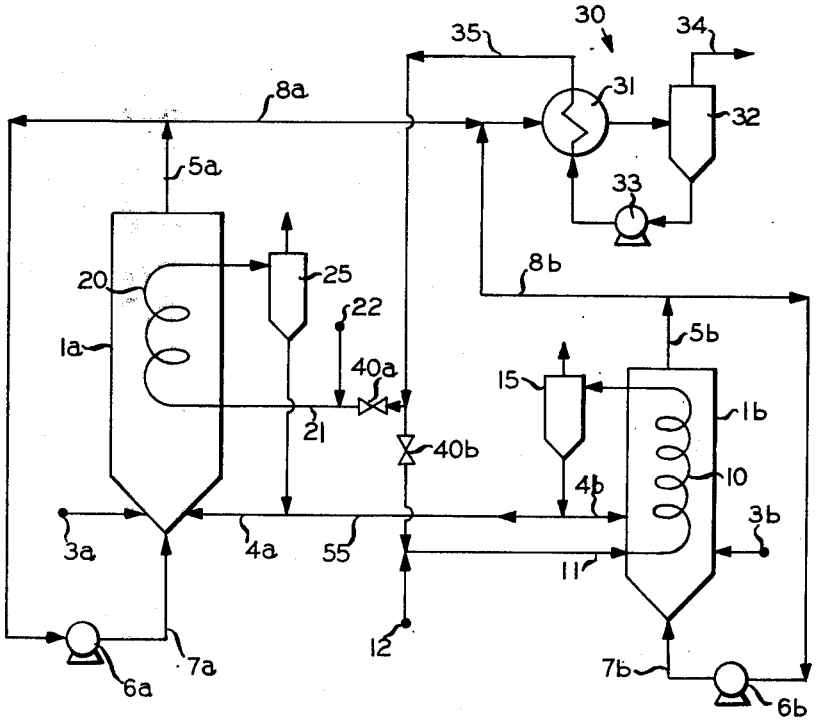

These and other objects, advantages, details, features and emmbodiments of this invention will become apparent to those skilled in the art from the following detailed description of the invention, the appended claims and the drawing which in FIGS. 1 and 2 show two schematic diagrams of an apparatus for carrying out the process of this invention.

In accordance with this invention, I have found that in a carbon monoxide producing process using zinc oxide as the oxygen source, the amount of heat generated by the reoxidation of zinc to zinc oxide becomes controllable without changing the quantity of zinc oxide circulated by reoxidizing a first portion of the zinc with air and a second portion of the zinc with $H_2O$. In a process for forming carbon monoxide out of the carbonaceous source and the zinc oxide in which zinc is reoxidized into zinc oxide in one reaction with air alone, this reoxidation furnishes essentially a constant amount of heat per unit of Zn reoxidized. Thus without changing the quantity of ZnO produced, the quantity of heat produced cannot be changed. Thus the temperature in the carbon monoxide-forming reaction cannot be controlled without changing the quantity of ZnO that is produced by the zinc oxidation in heat exchange with the CO-forming reaction. In accordance with my process, this is readily possible because the heat developed per mole of zinc oxide formed is dependent upon whether air or $H_2O$ is utilized as the oxygen source. The amount of heat developed by the oxidation of a given quantity of zinc with air is higher than the amount of heat developed by the oxidation of the same quantity of zinc with $H_2O$. Thus depending upon the relative sizes of the first and second portions of zinc, the total amount of heat developed by oxidizing a given quantity of zinc can be adjusted, changed or controlled without changing the total amount of zinc oxidized and thereby provide a thermally neutral system in which the heat liberated in the exothermic zinc oxidations essentially balances the heat requirements of the endothermic carbon oxidation reaction plus the system heat leak when the reactions are carried out in indirect heat exchange relationship with each other.

Another advantage of this invention resides in the production of relatively pure hydrogen as a by-product. This hydrogen can be combined with part of the CO produced to make methanol or methane. The hydrogen can also be used or sold as such.

More specifically, in accordance with this invention, there is now provided a process for the production of carbon monoxide from carbonaceous sources. This process comprises reacting a carbon source with zinc oxide to form a gaseous effluent comprising carbon monoxide and zinc, separating zinc from said gaseous effluent and recovering a carbon monoxide-containing gas as the product of the process, oxidizing a first portion of said zinc with air to form a first quantity of zinc oxide, oxidizing a second portion of said zinc with $H_2O$ to form a second quantity of zinc oxide, transferring at least a portion of the heat developed in these oxidizing steps to the CO-forming reaction step.

The carbon source in the carbon monoxide-forming reaction can be any carbon-containing material that will react with zinc oxide under elevated temperature conditions to form carbon monoxide and zinc. This carbon source is sometimes referred to as carbonaceous material. Preferably, the carbon source is a solid carbon source or a heavy liquid carbon source. By solid carbon source, those carbonaceous materials are meant that are essentially solid under normal temperature and pressure conditions. Examples for such carbon sources that can be utilized in the process of this invention and that constitute a preferred group are coal, coke, char, residual oils, tar and asphalt. Solid carbon sources, as defined above, such as coal, coke and char, are presently the most preferred carbon sources. The process of the present invention is in particular applicable to the gasification of char which is the solid residue of several coal gasification or pyrolysis processes such as the COED process (developed by the FMC Corporation), the Garrett process, the Synthane process, and the Toscoal process.

The solid carbon source materials are used in the process of this invention preferably in finely divided form in order to achieve as good and as much contact with the oxygen donor zinc oxide as possible. Preferably the solid carbon source materials will have a particle size of less than about 0.35 mm, which refers to the longest extension of the individual carbon source material particles.

The oxygen donor in the main carbon monoxide-forming reaction is zinc oxide (ZnO). This commercially available material is preferably used in finely divided form, usually as a powder. The particle size distribution of the zinc oxide preferably is such that all the particles are in the range of 0.2 to 5 microns in diameter. Smaller particles can also be utilized. Larger particles, whereas they can be utilized, have a tendency of slowing the reaction down and therefore are less desirable.

The carbon source and the zinc oxide are utilized generally in a quantity expressed as the equivalent ratio of zinc oxide to carbon in the range of 0.9 to 1.2. Preferably about 1.0 gram mole of zinc oxide per gram atom of available carbon in the carbon source is utilized. The quantity of available carbon in the carbon sources used is generally slightly smaller than the total carbon present in the source if carbonates are present.

The reaction conditions for the main CO-forming reaction between the carbon source and zinc oxide are not critical and preferably are as defined in the following. It is particularly desirable and preferred to operate at a temperature above the boiling point of zinc under the given pressure conditions so that the reaction results in a gaseous effluent, consisting essentially of carbon monoxide and zinc, from which zinc can be readily removed and reoxidized utilizing the heat of oxidation to at least partially supply the heat necessary for maintaining the main reaction. This main carbon monoxide-forming reaction is thus preferably carried out at a reaction temperature between 1665° F and 2800° F (910°–1540° C). Even more preferred is a temperature range of 1850° to 2150° F (1010–1176° C). If losses of zinc by zinc sulfide formation are to be avoided, i.e. particularly in case of the use of sulfur-containing carbon sources, a temperature range of 2200° to 2500° F (1205° to 1372° C) for the zinc oxide-forming reaction is preferred in order to remove the zinc sulfide in vapor form from the reactor.

The pressure conditions for the carbon monoxide-forming reaction are also not critical. Generally the reaction between the carbon source and the zinc oxide is carried out at slightly superatmospheric pressure. If desired, however, the reaction can be carried out at higher pressures and high-pressure carbon monoxide can be produced as the product of the process.

The time of the carbon monoxide-forming reaction between the carbonaceous source and the zinc oxide oxygen donor depends upon the temperature and pressure conditions used. Generally the time of reaction between the carbon source and the zinc oxide is determined essentially by economic reasons. The reaction is faster at higher temperatures so that the reaction time is shorter the higher the reaction temperature. preferably, therefore, the reaction time will be 5–120 minutes for reaction temperatures in the range of 2800° F to 1670° F (1540° to 910° C).

The relative quantities of zinc that are reoxidized with air and of zinc that are reoxidized with $H_2O$ depend upon the efficiency of the heat transfer from these exothermic oxidation reactions to the endothermic carbon monoxide-forming reaction. As a general rule, the relative quantity of zinc oxidized with air will be higher in cases where the heat to be transferred into the carbon monoxide-forming reaction is higher. Typically, the ratio of the first portion of the total zinc to be reoxidized with air to the second portion of the total zinc to be reoxidized with $H_2O$ will be in the range of 1.1 to 6.0.

Most preferably, the zinc-zinc oxide reactions of this invention are carried out in a cyclic manner in which the zinc oxide formed both by oxidation of zinc with air and with $H_2O$ is reintroduced into the main carbon monoxide-forming reaction. The two zinc oxide streams can be introduced separately or can be combined and introduced together into the carbon monoxide-forming reaction.

The splitting of the zinc stream to provide the two streams for the two separate reoxidations can be achieved anywhere downstream of the main carbon monoxide-forming reaction. Particularly, the gaseous effluent from the reactor can be split into two streams which are individually separated into a carbon monoxide and zinc stream to provide a first and a second zinc stream for the two reoxidation reactions. In another embodiment the total gaseous effluent is first separated into a gaseous carbon monoxide stream, the product of the process and a liquid zinc stream. This liquid zinc stream is then split into two liquid streams that are individually utilized for reoxidation with air on the one hand and $H_2O$ on the other hand.

Thus in accordance with a preferred embodiment of this invention, the carbon source and the zinc oxide are reacted in a reaction zone to form one gaseous effluent stream which is separated to form one stream of liquid zinc and one carbon monoxide stream. The zinc stream is split into a first and a second portion. The first portion of the zinc stream is oxidized in a first oxidation zone with air. The second portion of the zinc stream is oxidized in a second oxidation zone with $H_2O$. An indirect heat exchange is established between the reaction zone and both the first and the second oxidation zone.

A particularly efficient heat exchange can be achieved if at least a portion both of the first and the second oxidation zone is arranged in indirect heat exchange relationship with the one reaction zone mentioned above. This can be done by arranging the first and second oxidation zones as such within the reactor in which the carbon monoxide-forming reaction is carried out.

One of the main advantages of the present invention resides in the possibility of controlling the temperature of the reaction forming the carbon monoxide. To carry out this temperature control, it is presently preferred to determine the heat required for the carbon monoxide-forming reaction and to manipulate the ratio of the two zinc streams responsive to the heat requirement. More particularly, the ratio of the zinc stream oxidized with air to the zinc stream oxidized with $H_2O$ is increased when the heat required for the carbon monoxide-forming reaction is increased and vice versa.

In accordance with a preferred embodiment, the temperature of the reaction between the carbon source and zinc oxide is sensed and a reaction temperature signal is generated responsive thereto. Then the flow of the first portion of zinc or the flow of the second portion of zinc or both are manipulated responsive to this control signal such as to control the temperature in the reaction by controlling the quantity of heat developed in the overall oxidation of the zinc. Thereby without changing the quantity of total zinc flowing in the system, the heat developed in the exothermic reactions of the cyclic operation can be readily adjusted.

In accordance with a yet further embodiment of this invention, there is also provided an apparatus for the production of carbon monoxide from carbonaceous materials in which the process of this invention can be carried out. This apparatus comprises a reaction section having first inlet means and second inlet means and outlet means connected thereto, a source of carbonaceous materials connected to the first inlet means and a source of zinc oxide connected to the second inlet means. A separating means for separating zinc from the gaseous effluent from the reactor is connected to the outlet means and from these separating means a carbon monoxide-comprising stream can be withdrawn via one conduit and a liquid zinc stream can be withdrawn from another conduit. A first oxidizing unit in the apparatus of this invention is provided for the conversion of zinc to zinc oxide. This first oxidizing unit has a first zinc inlet connected to the separating means for introducing at least a portion of this zinc into the first oxidizing unit. The first oxidizing unit also has an air source connected to an air inlet of the oxidizing unit so that air can be injected into the first oxidizing unit and the zinc that is in this unit can be oxidized. The first oxidizing unit finally comprises a zinc oxide outlet means and a first gas outlet means. The apparatus of this invention further is provided with a second oxidizing unit having essentially the same function as the first oxidizing unit with the difference, however, that instead of an air source there is provided an $H_2O$ source and an $H_2O$ inlet to this first oxidizing unit so that zinc in this second oxidizing unit is contacted with $H_2O$ and converted into zinc oxide. The second oxidizing unit is also provided with a second zinc oxide outlet and a second gas outlet means. Both the first oxidizing unit and the second oxidizing unit are in indirect heat exchange relationship with the reaction section such as to transfer at least a portion of the heat developed in the two oxidizing units to the reaction section. The first and second zinc oxide outlets of the first and second zinc oxidizing units are operatively connected to the reaction section and to the second inlet means for the introduction of zinc oxide. Thus a gasification operation that is readily controllable can be carried out for converting carbonaceous materials into carbon monoxide.

Most preferably the reaction section consists of one reactor vessel and the two oxidizing units are at least partially arranged inside of this reactor vessel for indirect heat exchange between the interior of the oxidizing units and the interior of the reactor vessel. The structure of the two oxidizing units can be that of a vessel. It is advantageous to provide cyclone means in both oxidizinng units such as to separate the zinc oxide formed from the gas consisting essentially of nitrogen in the first oxidizing unit and from the gas consisting essentially of hydrogen in the second oxidizing unit. The zinc oxide produced in the two units and leaving the two cyclones is preferably combined and injected into the reaction section as a combined zinc oxide stream.

For an accurate, fast control of the apparatus, it is presently preferred that there is additionally provided a temperature sensing means for sensing the temperature in the reaction section and for generating a control signal responsive thereto. Flow manipulating means, such as a three-way valve in the zinc stream, are operatively connected to this temperature sensing means such as to increase or, respectively, decrease the flow rate of zinc into the first oxidizing unit and correspondingly decrease or, respectively, increase the flow rate of zinc into the second oxidizing unit responsive to the control signal if the temperature in the reaction section is below or, respectively, above a setpoint temperature.

The invention will yet be more fully understood from the following description of the drawings and the calculated typical example.

In FIG. 1 a main reaction vessel 1 is provided for into which carbonaceous material is introduced via line 2 from a source 3 of carbonaceous material. Zinc oxide is introduced into the reaction vessel 1 via line 4. The gaseous effluent leaving the reactor vessel 1 via line 5 is essentially composed of carbon monoxide and zinc. A portion of this gaseous effluent is recycled directly into the reactor vessel 1 by means of pump 6 through line 7 such as to fluidize the materials in the reactor 1. A first oxidation unit 10 and a second oxidation unit 20 are arranged within the reaction vessel 1 in indirect heat exchange relationship with the materials in the vessel. The structure of the two oxidizing units can be that of a vessel. The function of these oxidation units will be explained later. The balance of the gaseous effluent from line 5 is passed via line 8 into a condensing and separating unit 30. This condensing and separating unit 30 comprises an indirect heat exchange means 31 and a gas/liquid separating unit 32, as well as a pump 33. In the heat exchanger 31, the liquid zinc precools the gaseous effluent in line 8 and thereby the liquid zinc is at least partially reevaporated. The vessel 32 serves as a separaing unit for separating liquid zinc and gas. The gas consisting essentially of carbon monoxide leaves the gas/liquid separating means 32 by way of line 34. Liquid zinc is pumped from the gas/liquid separating means 32 by means of pump 33 through the heat exchanger 31. Optionally, a further evaporating means to evaporate zinc can be provided for which is not shown in the drawing and which would be arranged downstream of the heat exchange means 31 in the zinc line 35. The zinc stream is then passed through a three-way valve 40 where it is split into a first stream 21 and a second stream 11. The first stream 21 is mixed with air from an air source 22 and the mixture of zinc and air is passed via line 23 into the oxidizing unit 20. In this oxidizing unit the zinc and air react to form essentially zinc oxide and nitrogen. The effluent from the oxidizing unit 20 is passed via line 24 to a separating means 25 such as a cyclone. In this cyclone 25 the solid zinc oxide is collected in the bottom and the gas consisting essentially of nitrogen leaves the cyclone 25 via line 26.

Similarly, the second portion of the zinc stream flowing in line 11 is mixed with $H_2O$, preferably in the form of steam that comes from an $H_2O$ source 12. The mixture of steam and zinc is passed via line 13 into the second oxidizing unit 10 where this mixture is essentially converted in an exothermic reaction into zinc oxide and hydrogen. The zinc oxide/hydrogen mixture is passed via line 14 into a gas/solid separating means such as a cyclone 15. The solid zinc oxide is accumulated in the bottom of the cyclone and the gaseous effluent consisting essentially of hydrogen leaves the cyclone via line 16.

Zinc oxide leaving the two cyclones 15 and 25 via lines 17 and 27, respectively, are combined in line 4 and injected into the reactor vessel 1 as the oxygen donor for the carbon monoxide-forming reaction.

A control system for a simple control of the temperature in the reaction vessel 1 is also provided for. A sensing means 50, such as a thermocouple, measures the temperature and generates a signal responsive thereto. A controller 51 compares this reaction temperature signal with a setpoint signal from a setpoint signal source 52 and generates a control signal via line 53 responsive thereto. This control signal operates the three-way valve 40 in such a manner that the relative quantity of zinc flowing into the first oxidizing unit 20 is increased whenever the temperature sensed by the thermocouple 50 is below the setpoint and correspondingly increases the relative quantity of zinc flowing through the second oxidizing unit 10 whenever that temperature is above the setpoint.

Another embodiment of the apparatus for carrying out the present invention is shown in FIG. 2. In this system instead of one reactor there are provided two reactors, 1*a* and 1*b*, in which carbon-containing material from the source 3*a* or, respectively, 3*b* is reacted with zinc oxide introduced via line 4*a* or, respectively, 4*b* to form carbon monoxide and zinc vapor which gas mixture is withdrawn via line 5*a* or, respectively, 5*b*. Similarly, there is provided a direct recycle stream of effluent gas which is injected by means of pump 6*a* or 6*b* via line 7*a* or line 7*b* as a fluidizing gas. In the reactor 1*a* the oxidizing unit 20 is arranged whereas the oxidizing unit 10 is arranged within the reactor 1*b*. The balance of the gaseous effluent from the two reactors in lines 8*a* and 8*b* are combined and separated in the separating unit 30, which is the same as that shown in FIG. 1, into a gas stream consisting essentially of carbon monoxide in line 34 and a zinc stream in line 35. This zinc stream in accordance with the invention is then split into a first stream 21 for the reoxidation with air from air source 22 and a second stream in line 11 for the reoxidation with an $H_2O$ stream from $H_2O$ source 12. Two valves 40*a* and 40*b* are provided to control the relative amounts of zinc flowing into the two oxidation units. The two zinc oxide outlets of the two cyclones 15 and 25 are interconnected by a line 55. Since the heat generated by oxidizing zinc with $H_2O$ per mole of zinc is less than the amount of heat consumed by the production of 1 mole of zinc and 1 mole of carbon monoxide, a larger quantity of zinc has to be oxidized in reoxidation unit 10 than that which is chemically necessary in the reactor 1*b*. Therefore, the difference of zinc oxide produced in the reoxidation unit 10 is transferred via line 55 and line 4*a* into the reactor 1*a*.

To further illustrate the invention, the following calculated example is given.

EXAMPLE

Flow quantities in kilogram moles per hour are shown in the following table for an idealized case assuming 100% conversion of the char, entrance and exit of all reactants and products at 77° F (25° C) and an operation temperature of the gasifier reactor 1 at 2077° F (1137° C) under a pressure of between 1 and 4 atmospheres. The following table shows a material balance for these materials. The figures shown in parenthesis refer to the drawing.

TABLE

| | Char(2) | Water(12) | Air(22) | Product Oxides(34) | Zinc(35) | Hydrogen(16) | Nitrogen(26) |
|---|---|---|---|---|---|---|---|
| Carbon (C) | 6.36 | | | | | | |
| Hydrogen (H) | 0.80 | | | | | | |
| Nitrogen (N) | 0.04 | | | | | | |
| Sulfur (S) | 0.11 | | | | | | |
| Oxygen ($O_2$) | | | 1.91 | | | | |
| Nitrogen ($N_2$) | | | 7.22 | | | | 7.22 |
| CO | | | | 6.12 | | | |
| $CO_2$ | | | | 0.24 | | | |
| NO | | | | 0.04 | | | |
| $SO_2$ | | | | 0.11 | | | |
| Zn | | | | | 7.27 | | |
| Ash | 0.18 | | | | | | |
| Water | | 3.45 | | 0.40 | | | |
| Hydrogen ($H_2$) | | | | | | 3.45 | |
| Totals | 7.49 | 3.45 | 9.13 | 6.91 | 7.27 | 3.45 | 7.22 |

If an overall efficiency of only 70% is assumed allowing for heat leakage, heat exchange losses and the like, the corresponding feed rates would be 1.13 kilogram moles per hour of water and 3.07 kilogram moles per hour of oxygen.

The 7.27 kilogram moles of zinc circulating in the systemin case of a 100% conversion under the conditions given above, would be split into 3.45 kilogram moles in line 11 and 3.82 kilogram moles in line 21. Correspondingly, for only a 70% efficient process as indicated, the 7.27 kilogram moles of zinc circulating in the system would be split into 1.13 kilogram moles in line 11 and 6.14 kilogram moles in line 21.

Reasonable variations and modifications which will become apparent to those skilled in the art can be made in this invention without departing from the spirit and scope thereof.

I claim:

1. A process for the production of carbon monoxide comprising a. reacting a carbon source with ZnO under such conditions of temperature and pressure that the temperature is at or above the boiling point of zinc under the given pressure conditions and that the reaction forms a gaseous effluent comprising CO and Zn, b. separating Zn from said gaseous effluent and removing a CO containing gas as the product of the process, c. oxidizing a first portion of said Zn with air to form a first quantity of ZnO, d. oxidizing a second portion of said Zn with $H_2O$ to form a second quantity of ZnO, and e. transferring at least a portion of the heat developed in the oxidizing steps c and d to the reaction step a by indirect heat exchange means.

2. A process in accordance with claim 1 wherein said carbon source and said ZnO are reacted in a reaction zone to form a gaseous effluent stream which is separated to form a stream of liquid zinc and one carbon monoxide stream, wherein said stream of liquid zinc is split into said first and second portions of said zinc, wherein said first portion of said zinc is oxidized with air in a first oxidation zone to form a first quantity of ZnO, wherein said second portion of said zinc is reacted in a second oxidation zone with $H_2O$ to form a second quantity of ZnO, wherein said first and said second quantity of ZnO formed are both introduced into said reaction zone, and wherein indirect heat exchange is established between said one reaction zone and both said first and said second oxidation zones.

3. A process in accordance with claim 2 wherein at least a portion of said first and said second oxidation zone is arranged in indirect heat exchange within said reaction zone.

4. A process in accordance with claim 1 wherein said first and said second quantity of ZnO are reintroduced into said reaction step (a).

5. A process in accordance with claim 1 wherein the temperature of the reaction of step (a) is sensed in at least one location and a reaction temperature signal is generated responsive thereto and wherein the flow of the first portion of zinc or the flow of the second portion of zinc or both are manipulated responsive thereto.

6. A process in accordance with claim 1 wherein the heat required for the endothermic reaction in step (a) is determined and a control signal is generated responsive thereto, and wherein the ratio of the first to the second portion of zinc is manipulated responsive to said control signal.

7. A process in accordance with claim 1 wherein a first part of said carbon source and a first part of said zinc oxide are reacted in a first reaction zone to form a first gaseous effluent comprising carbon monoxide and zinc, wherein a second part of said carbon source and a second part of said zinc oxide are reacted in a second reaction zone to form a second gaseous effluent of carbon monoxide and zinc, wherein zinc is separated from said first and said second gaseous effluent to result in said zinc and said carbon monoxide comprising gaseous effluent which is recovered as a product of the process, wherein heat from said oxidation step (c) is transferred to said first reaction zone and wherein heat from said oxidation step (d) is transferred to said second reaction zone.

8. A process in accordance with claim 7 wherein said first and said second gaseous effluent are combined into said gaseous effluent.

9. A process in accordance with claim 7 wherein a portion of the zinc oxide formed in the oxidation step (d) is introduced into said first reaction zone whereas the remainder of the zinc oxide formed in said oxidation step (d) is introduced into the second reaction zone and wherein all the zinc oxide formed in the oxidation step (c) is introduced into the first reaction zone.

10. An apparatus for producing carbon monoxide from carbonaceous materials comprising:

a. a reaction section having first inlet means and second inlet means and outlet means connected thereto, b. means to introduce carbonaceous material connected to said first inlet means, c. means to introduce zinc oxide connected to said second inlet means, d. separating means connected to said outlet means for separating a gaseous effluent into a liquid zinc stream and a carbon monoxide stream, e. first oxidizing means for the conversion of zinc into zinc oxide having a first zinc inlet connected to said separating means for introducing at least a portion of said zinc into said first oxidizing means, an air source connected to said first oxidizing means for injecting air and oxidizing zinc, and a first zinc oxide outlet means and a first gas outlet means, said first oxidizing unit being in indirect heat exchange relationship with said reaction section, f. second oxidizing means for the conversion of zinc into zinc oxide having a second zinc inlet connected to said separating means for introducing at least a portion of said zinc into said second oxidizing means, an $H_2O$ source connected to said second oxidizing means for injecting $H_2O$ and oxidizing zinc, a second zinc oxide outlet means and a second gas outlet means, said second oxidizing means being also in indirect heat exchange relationship with said reaction section, g. said first and second zinc oxide outlet means operatively connected to said reaction section for introducing the zinc oxide formed in said first and second oxidizing means into said reaction section.

11. An apparatus in accordance with claim 10 wherein said reaction section is one reactor vessel, wherein said first and said second oxidizing means are vessels at least partially arranged inside of said reaction vessel for indirect heat exchange between the interior of said oxidizing vessels and the interior of said reactor vessel.

12. An apparatus in accordance with claim 10 wherein said first and said second oxidizing means each comprise an oxidizing vessel and a cyclone gas/solids separator means operatively connected to each other.

13. An apparatus in accordance with claim 12 wherein said gas/solids separator means is a cyclone.

14. An apparatus in accordance with claim 10 further comprising temperature sensing means for sensing the temperature in said reaction section and generating a control signal responsive thereto, flow manipulating means operatively connected to said temperature sensing means for increasing (respectively, decreasing) of the flow rate of zinc into the first oxidizing means and correspondingly decreasing (respectively, increasing) the flow rate of zinc into the second oxidizing means responsive to said control signal if the temperature in said reaction section is below (respectively, above) a setpoint temperature.

* * * * *